United States Patent [19]

Bleikamp, Jr.

[11] 4,330,685

[45] May 18, 1982

[54] INSULATED WIRE HAVING A CONTROLLED SPECIFIC GRAVITY

[75] Inventor: Roy H. Bleikamp, Jr., Chesterfield, Mo.

[73] Assignee: Monsanto Company, St. Louis, Mo.

[21] Appl. No.: 184,705

[22] Filed: Sep. 8, 1980

[51] Int. Cl.[3] ..... H01B 7/12

[52] U.S. Cl. ..... 174/101.5; 174/107; 174/110 F

[58] Field of Search ..... 174/28, 101.5, 110 F, 174/107; 204/180 R, 186, 229 R, 305; 340/7 R; 57/217

[56] References Cited

U.S. PATENT DOCUMENTS

| | | | |
|---|---|---|---|
| 298,490 | 5/1943 | Hoekstra | 174/110 F |
| 2,424,388 | 7/1947 | Duna | 174/101.5 |
| 2,454,800 | 11/1948 | Hartstein et al. | 174/28 |
| 3,040,278 | 6/1962 | Griemsmann | 174/110 F X |
| 3,605,398 | 9/1971 | Carlson et al. | 57/217 |
| 3,740,454 | 6/1973 | Arndt et al. | 174/101.5 |
| 3,744,016 | 7/1973 | Davis | 340/7 R |
| 4,115,233 | 9/1978 | Griffith | 204/180 R |

FOREIGN PATENT DOCUMENTS

| | | | |
|---|---|---|---|
| 1147281 | 4/1963 | Fed. Rep. of Germany | 174/110 F |

*Primary Examiner*—Volodymyr Y. Mayewsky
*Attorney, Agent, or Firm*—Lawrence L. Limpus

[57] ABSTRACT

An insulated wire having a controlled specific gravity is provided. The wire is manufactured by surrounding an electrical conductor with a layer or a closed cell foam and a sheath. The density and outer diameter of the layer of closed cell foam are controlled to provide the desired overall specific gravity of the insulated wire so that the insulated wire will float on the interface between two immiscible fluids which have different specific gravities.

3 Claims, 2 Drawing Figures

INSULATED WIRE HAVING A CONTROLLED SPECIFIC GRAVITY

BACKGROUND OF THE INVENTION

This invention relates to an insulated wire or electrical cable having a specific gravity that is closely controlled. More specifically this invention relates to an insulated wire having a controlled specific gravity such that the wire will float on the interface between two essentially immiscible fluids having specific gravities different from one another.

In many industrial processes, aqueous dispersions of solids are obtained as waste streams. It is a common practice to retain such wastes in large ponds or other containment means. Numerous efforts have been made to promote a solids-free aqueous phase which may be disposed of. One method of concentrating the solids is through the use of electroendosmosis as shown in U.S. Pat. No. 4,115,233. Each electrode in such a system must be connected by a wire or electrical cable to the power source.

In a containment pond such as in U.S. Pat. No. 4,115,233, there is a layer of essentially clear water overlaying many feet of mud of varying density. The mud typically ranges in density according to its age, or the time during which it has been settling; it appears to vary from a specific gravity of approximately 1.08 at the interface with the overlaying water, to approximately 1.5 at the bottom of the pond. The lower limit of specific gravity is probably not a discrete value as the mud is fluid or semi-fluid in nature up to at least a specific gravity of 1.08. It then becomes gelatinous in nature, and at still higher values it becomes plastic and then solid in nature.

When conventional insulated wire is used under these conditions, it tends to settle into the mud to a depth where the shear strength of the mud is sufficient to support the weight of the wire. Since it enters the pond at the surface, and also is suspended near the surface at the electrodes, the wire can be visualized as hanging in a crude catenary into the mud. When the mud is densified by the electroendosmosis system, the mud traps the wire in its plastic or solid phase. Then, as the mud either settles or shifts, it imposes high stresses on the trapped wire, either breaking it or pulling it loose from its connection at the electrodes.

The wire could be designed to have a specific gravity of less than unity, or be attached to floats, so that it would not become trapped in the mud. However, it would then interfere with accessibility for maintenance of the system, by boat for example. It would also be subjected the nearly continuous motion from wave action, subjecting it to varying stresses and possible fatigue failure.

The wire of this invention resembles wire used for coaxial cable, except that no metallic or conductive shield is used. In coaxial cable, the outer conductive shield is held away from the central conductor at a controlled distance to control its impedance. Frequently low-density material such as foam is used for this purpose, but in that application dimensional control, not control of specific gravity, is the important factor.

SUMMARY OF THE INVENTION

It is an object of this invention to provide an insulated wire having a closely controlled specific gravity. It is a further object of this invention to provide an insulated wire having a controlled specific gravity such that the wire will float on the interface between two essentially immiscible fluids having specific gravities different from one another.

In furtherance of these objectives and others which may become apparent there is provided an insulated wire or electrical cable, an electrical conductor which has an insulating layer of closed-cell foam, closely controlled to provide the correct over all specific gravity for the wire, and a sheath for strength and abrasion resistance to protect the inner foam layer.

BRIEF DESCRIPTION OF THE DRAWINGS

Attention is now directed toward the drawings in which.

DETAILED DESCRIPTION OF THE PREFERRED EMBODIMENT

Figure 1:
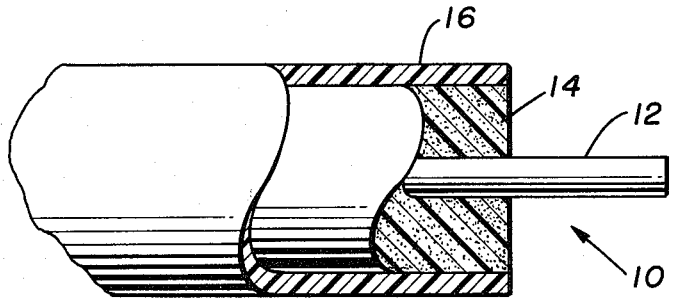
FIG. 1 is a partial cross-sectional view of the insulated wire of this invention.
Figure 2:
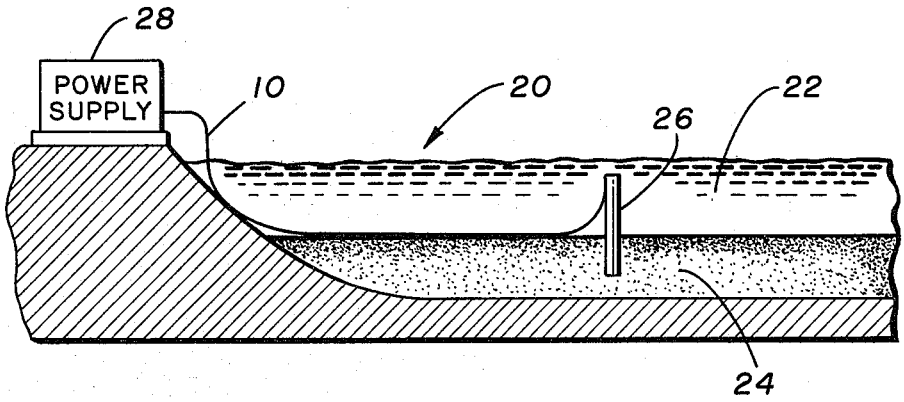
FIG. 2 is a cross-sectional view of a containment pond showing the use of the insulated wire of this invention.

Referring now to FIG. 1, the insulated wire of this invention is shown. The insulated wire 10 has a central electrical conductor 12, a stranded or solid wire typically made of copper or aluminum, which is properly sized for conduction of the electrical power required by an electrode system as shown in FIG. 2. The insulated wire 10 has as its insulation one or more layers of low-density material, here shown as a single layer of closed-cell foam 14, for example a polyethylene or polyurethane foam. A layer or sheath 16 of a high molecular-weight, low density material such as polyethylene surrounds the layer of closed-cell foam to provide strength and resistance to abrasion. Both the density and the outer diameter of the layer of closed-cell foam 14 are closely controlled such that the overall specific gravity of the insulated wire 10 is greater than 1.0 but less than 1.08 and preferably the overall specific gravity of the insulated wire is greater than 1.02 but less than 1.05.

Turning now to FIG. 2, the use of the insulated wire 10 of this invention is shown in a containment pond 20. Containment pond 20 has been filled with an aqueous dispersion of solids which have been allowed to settle to form a layer of essentially clear water 22 overlaying the settling muds 24. An electrode 26, part of an electroendosmosis system, is used to increase the speed of concentration, or dewatering, of the setting mud 24. The electrode 26 is supported within the containment pond 20 by floatation equipment that is now shown in FIG. 2. A power source 28 for the electroendosmosis system is mounted at the edge of the containment pond 20. Insulated wire 10 is provided to conduct electrical power from the power source 28 to electrode 26. Wire 10 floats on the surface of the mud within the containment pond at the interface between the layer of essentially clear water 22 and the settling mud 24.

In FIG. 2, one insulated wire 10 and one electrode 26 are shown for illustration of this invention. However, an electroendosmosis system would have a plurality of electrodes 26 and an insulated wire 10 would be necessary for each of the plurality of electrodes 26.

As noted above, the density and outer diameter of the layer of closed-cell foam 14 of the insulated wire 10 are closely controlled such that the insulated wire 10 has an overall specific gravity that is preferably greater than 1.02 but less than 1.05. The insulated wire 10 therefore sinks in the overlying water, but "floats" on the surface of the mud, or essentially at the interface of the two. Since the mud is fluid in nature in this region, the addition of more mud at the surface, or consolidation of the mud beneath the wire does not affect the wire; it floats up to its matching specific gravity.

By the use of this invention, an insulated wire is provided that will float on the interface between two essentially immiscible fluids. In the description of this invention, the fluids discussed were water and the settling mud from industrial waste streams. However, the insulated wire of the invention may be used with the fluids of other processes. If the other fluids have a specific gravity greatly different from that of water, then the specific gravity of the wire must be chosen and controlled to be within a range compatible with these other fluids.

Having thus shown and described the preferred embodiments of the present invention, it will be apparent to those skilled in the art that many modifications and variations are possible in light of the above teachings. It is therefore to be understood that my invention may be practiced other than as herein specifically described.

I claim:

1. An insulated wire having a controlled specific gravity which will float on the interface between two immiscible fluids having different specific gravities comprising:

an electrical conductor, a layer of a closed cell foam surrounding said electrical conductor, said layer of closed cell foam electrically insulating said electrical conductor and having a controlled density and outer diameter such that the specific gravity of said insulated wire is greater than the specific gravity of the upper immiscible fluid and is less than the specific gravity of the lower immiscible fluid, and a sheath surrounding said layer of a closed cell foam, whereby said insulated wire will float on the interface between said upper and lower immiscible fluids.

2. The insulated wire of claim 1 wherein the density and the outer diameter of said layer of closed cell foam are controlled such that said insulated wire has a specific gravity greater than 1.0 and less than 1.08.

3. The insulated wire of claim 2 wherein said specific gravity is greater than 1.02 and less than 1.05.

* * * * *